US008622712B2

(12) United States Patent
Wiegel et al.

(10) Patent No.: US 8,622,712 B2
(45) Date of Patent: Jan. 7, 2014

(54) SPRINKLER-COMPATIBLE CEILING FANS

(75) Inventors: Aaron J. Wiegel, Benton, IA (US); Daniel M. Anderson, Oak Creek, WI (US); Donald P. Grant, Dubuque, IA (US); Jason Dondlinger, Bellevue, IA (US); Joe Korman, Dubuque, IA (US); Mark G. Petri, Mequon, WI (US); Matthew C. McNeill, Mequon, WI (US); Ronald P. Snyder, Dubuque, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 1282 days.

(21) Appl. No.: 12/228,170

(22) Filed: Aug. 11, 2008

(65) Prior Publication Data

US 2010/0034664 A1 Feb. 11, 2010

(51) Int. Cl.
*F04B 49/00* (2006.01)
*A47C 7/74* (2006.01)
*F01D 15/12* (2006.01)

(52) U.S. Cl.
USPC ..... 417/14; 416/169 A; 415/123

(58) Field of Classification Search
USPC ..... 416/169 R; 417/424.1; 415/123; 169/91, 169/5, 37, 54, 56, 70
See application file for complete search history.

(56) References Cited

U.S. PATENT DOCUMENTS 2,586,797 A * 2/1952 Dunlop et al. ..... 169/48
3,176,173 A * 3/1965 Straub et al. ..... 310/59
3,197,003 A * 7/1965 Yetter ..... 192/84.3
4,592,702 A * 6/1986 Bogage ..... 416/247 R
4,991,657 A * 2/1991 LeLande, Jr. ..... 169/46
5,016,715 A * 5/1991 Alasio ..... 169/61
5,135,365 A * 8/1992 Bogage ..... 417/423.15
5,562,164 A * 10/1996 McMurray ..... 169/54
5,562,418 A * 10/1996 Agius ..... 416/169 R
5,988,264 A * 11/1999 Goldsmith ..... 165/48.1
6,015,274 A * 1/2000 Bias et al. ..... 417/423.1
7,306,045 B1 * 12/2007 Moflihi ..... 169/70
7,658,232 B2 * 2/2010 Anderson et al. ..... 169/61
2003/0121672 A1 * 7/2003 Spaniol et al. ..... 169/5
2005/0046563 A1 * 3/2005 Whitney ..... 340/506
2005/0141997 A1 * 6/2005 Rast ..... 416/229 R (Continued)

OTHER PUBLICATIONS

International Searching Authority, "International Search Report," issued in connection with international application serial No. PCT/US2009/053158, mailed Nov. 11, 2009, 4 pages.
International Searching Authority, "Written Opinion of the International Searching Authority," issued in connection with international application serial No. PCT/US2009/053158, mailed Nov. 11, 2009, 7 pages.

(Continued)

*Primary Examiner* — Charles Freay
*Assistant Examiner* — Alexander Comley
(74) *Attorney, Agent, or Firm* — Hanley, Flight & Zimmerman, LLC

(57) ABSTRACT

In the event of a fire, in some examples, a ceiling fan stops its fan blades at a predetermined position so as to avoid obstructing the spray from an overhead sprinkler head. The fan can be stopped by various apparatus including, but not limited to, a spring loaded roller engaging a lobed member to urge the fan to a chosen stop position, an electromechanical brake that grips a rotating member at certain locations, a stationary magnet attracted to one or more iron pads that rotate to certain locations, and a motor controller responsive to a rotational position sensor.

21 Claims, 5 Drawing Sheets

(56) References Cited

U.S. PATENT DOCUMENTS

| | | | | |
|---|---|---|---|---|
| 2006/0009863 | A1* | 1/2006 | Lingemann | 700/19 |
| 2007/0036654 | A1* | 2/2007 | Fedeli et al. | 416/169 R |
| 2008/0193294 | A1* | 8/2008 | Grant et al. | 416/204 R |
| 2008/0277124 | A1* | 11/2008 | Johnston et al. | 169/37 |
| 2009/0178815 | A1* | 7/2009 | Anderson et al. | 169/61 |

OTHER PUBLICATIONS

International Bureau, "International Preliminary Report on Patentability," issued in connection with international application serial No. PCT/US2009/053158, issued Feb. 15, 2011, mailed Feb. 24, 2011, 8 pages.

* cited by examiner

SPRINKLER-COMPATIBLE CEILING FANS

FIELD OF THE DISCLOSURE

This patent generally pertains to ceiling fans and, more specifically, to ceiling fans in the vicinity of an overhead fire sprinkler head.

BACKGROUND

Ceiling mounted fans are often used for circulating air within large buildings such as warehouses, factories, gymnasiums, churches, auditoriums, convention centers, theaters, and other buildings with large open areas. For fire safety, sprinkler heads are usually installed near the ceiling and are used for spraying water or other fire-suppressing media on any fires that might occur within the building. In the event of a fire, the fans can be turned off to avoid fanning the fire while the sprinklers are activated to quench the fire.

In some cases, a sprinkler head might be installed directly above the fan blades. In such situations, the fan blades might obstruct or interfere with the water spraying from the sprinkler head, regardless of whether the fan blades are rotating or stationary. Although it might be possible to relocate the fan or sprinkler so that they are farther apart, large diameter fans can be particularly difficult to fit among a relatively dense matrix of sprinkler heads.

A similar interference problem might occur between a ceiling fan and a nearby overhead light fixture. Fan blades rotating underneath a light fixture might not be much of a problem; however, if one of the fan blades stops directly underneath the light when the fan turns off, that single stationary fan blade might block a noticeable amount of light.

DETAILED DESCRIPTION

Figure 1:
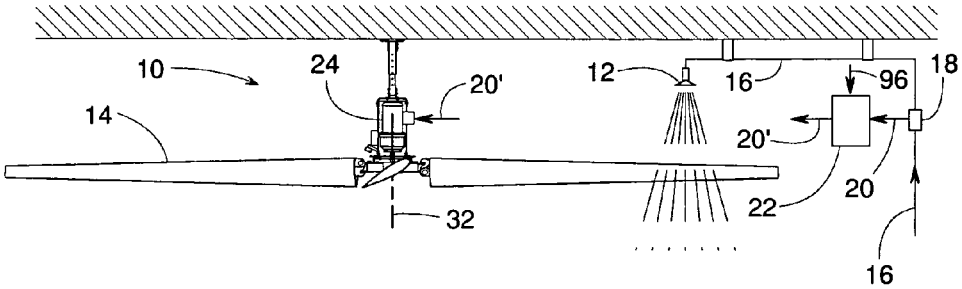
FIG. 1 is a side view of a ceiling fan operating with the fan blades spinning freely in the vicinity of an overhead sprinkler head.

Certain examples are shown in the above-identified figures and described in detail below. In describing these examples, like or identical reference numbers are used to identify the same or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

FIGS. 1-8 show an example of a ceiling fan 10, for ventilation, mountable in proximity with a fire sprinkler head 12 for extinguishing a fire in a building. Fan 10 being in proximity with sprinkler head 12 means that when sprinkler head 12 is activated, spray from sprinkler head 12 can reach the fan's plurality of fan blades 14 when fan blades 14 are rotating.

The term, "fire" used herein refers to any burning event or state of combustion including, but not limited to, an open flame and flameless smoldering.

Upon sensing a characteristic associated with a fire, a sensor triggers the operation of sprinkler head 12 so that sprinkler head 12 sprays a fire-extinguishing fluid (e.g., water) from a supply line 16 onto the fire. Examples of a characteristic associated with a fire include, but are not limited to, heat, smoke, and light. In some examples, an optical or ionization detector senses smoke and activates a solenoid valve that supplies water to sprinkler head 12. In another example, a fusible link on a valve portion of sprinkler head 12 melts in the presence of heat to activate sprinkler head 12. Sprinkler head 12 is schematically illustrated to represent the aforementioned examples as well as other sprinkler-activating methods commonly known to those of ordinary skill in the art.

In addition to activating sprinkler head 12 in the event of a fire, fan 10 preferably is de-energized or turned off automatically so as not to fan the fire or significantly interfere with the spray pattern of sprinkler head 12. In some examples, fan 10 is automatically turned off in response to a fire-related sensor 18, which can be any sensor responsive to a characteristic or event associated with a fire. Sensor 18, for instance, can be a water flow sensor in supply line 16. When sprinkler head 12 is open, sensor 18 provides a signal 20 upon sensing water flowing through supply line 16. In this example, water flowing through supply line 16 is the characteristic associated with a fire. To turn fan 10 off, signal 20 is conveyed to a controller 22 (e.g., motor starter, electrical contacts, variable frequency drive, etc.) that controls the operation of a motor 24 via a signal 20', wherein motor 24 includes a fan rotor 26 (fan rotor 26 is the rotating portion of the fan). Fan rotor 26 includes a rotor 28 inductively coupled to a stator 30 of motor 24, the rotating fan blades 14, and any mechanical coupling that might couple rotor 28 to fan blades 14. Motor 24 rotates fan blades 14 about an axis 32.

To prevent fan blades 14 from stopping at a location that significantly interferes with the spray pattern of sprinkler head 12, the example fan rotor 26 disclosed herein is biased to one or more likely stop positions when the fan 10 is turned off. The expressions, "likely stop position" and "likely stop positions," refer to one or more points or general locations where fan rotor 26 is intended to stop more often than other points or locations through which fan rotor 24 passes.

Figure 2:
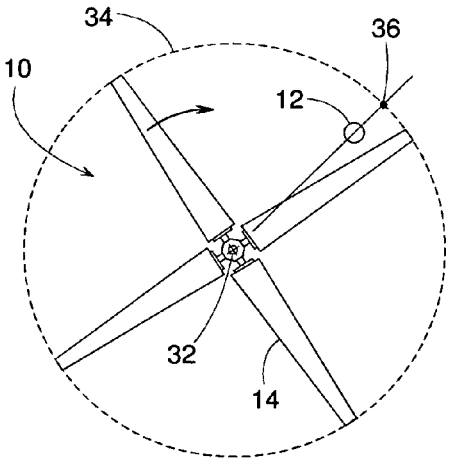
FIG. 2 is a bottom view of the ceiling fan of FIG. 1 with the fan blades rotating underneath the sprinkler head.
Figure 3:
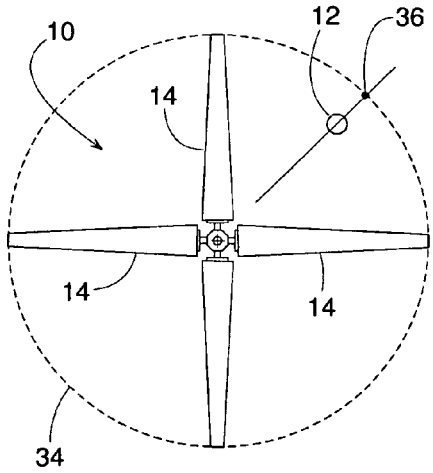
FIG. 3 is a bottom view similar to FIG. 2 but showing the fan having stopped at a chosen location.
Figure 4:
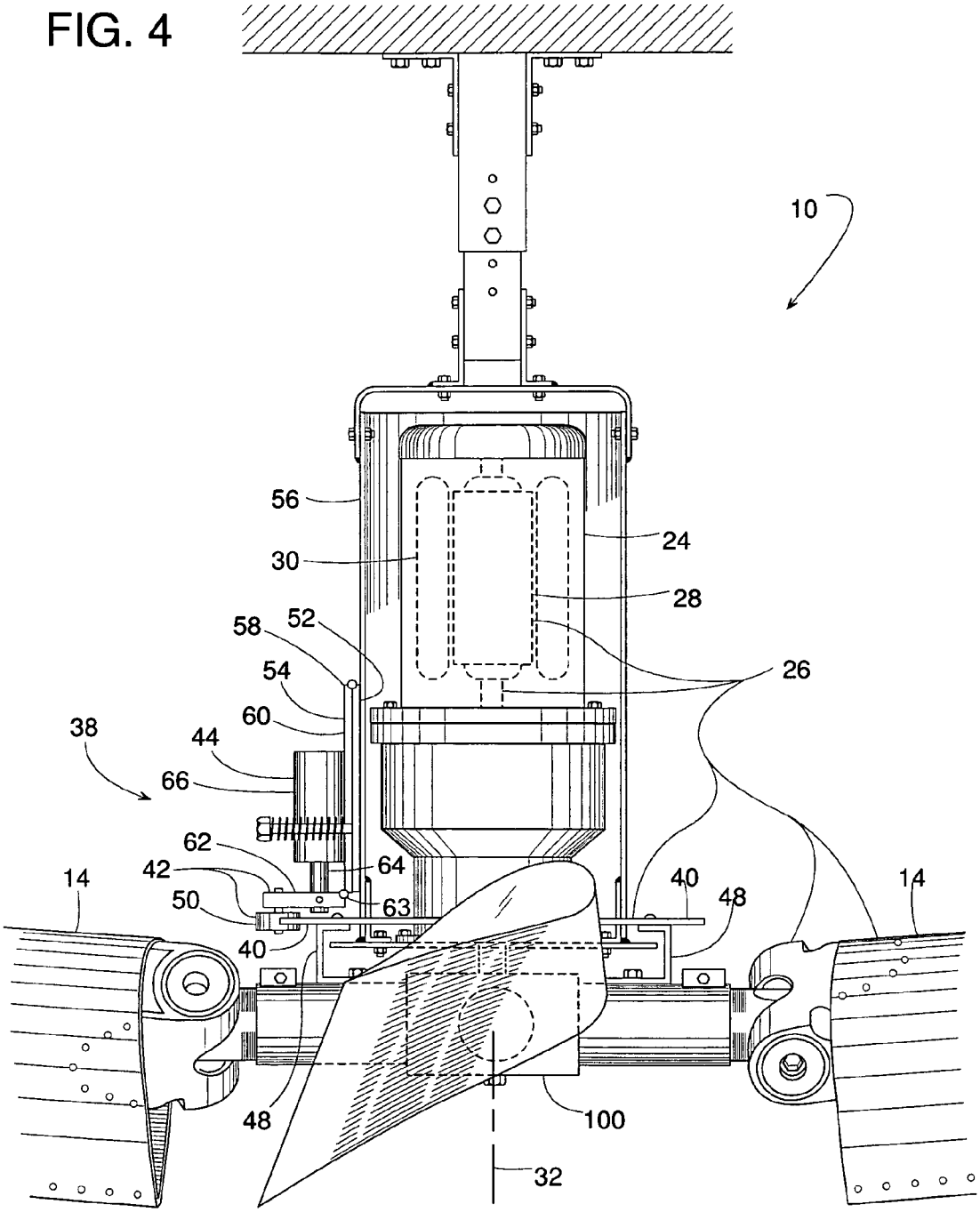
FIG. 4 is a close-up side view of FIG. 1 but with a stop mechanism engaged to urge the fan to stop at the position of FIG. 3.

Referring to FIGS. 2 and 3, for instance, when fan 10 is turned on, fan blades 14 sweep along a generally circular path 34 (FIG. 2). When fan 10 turns off (FIG. 3), it may be desirable to have fan blades 14 purposely avoid stopping at a predetermined point 36. The expression, "purposely avoids," means the avoidance is intentional and not simply a permanent magnet stepper motor just happening to stop at some discrete circumferential step. Although point 36 can be any user-chosen point on path 34, for the illustrated example, point 36 is radially inline with sprinkler head 12 so that none of fan blades 14 tend to stop directly underneath sprinkler head 12.

In other examples, stopping a single fan blade 14 directly underneath a sprinkler head 12 might actually create less spray interference and be more desirable than stopping the fan blades 14 with the sprinkler head 12 midway between two fan blades 14. Thus, selecting point 36 based on the location of sprinkler head 12 means that the location of point 36 is chosen with reference to the location of sprinkler head 12 but does not necessarily mean that point 36 and sprinkler head 12 are radially inline with each other.

For sake of example, predetermined point 36 will be inline with sprinkler head 12, and the likely stop positions will be wherever fan 10 stops with sprinkler head 12 being generally midway between any two fan blades 14, as shown in FIG. 3. Biasing fan rotor 26 to stop at any one of four likely stop positions can be accomplished in many different ways within the scope of this disclosure.

Figure 5:
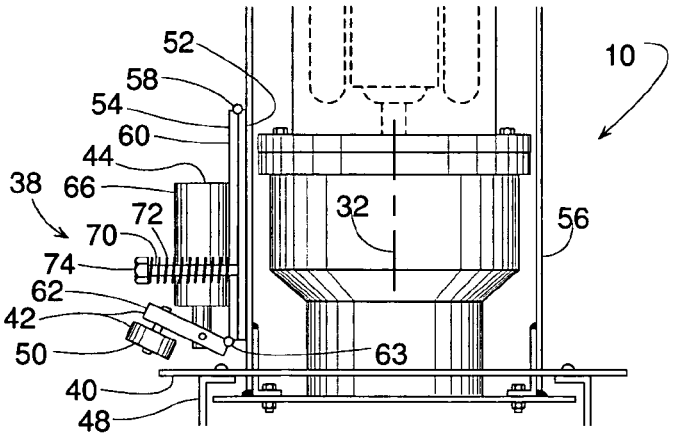
FIG. 5 is another close-up side view of FIG. 1 with the stop mechanism disengaged to allow the fan blades to spin freely.
Figure 6:
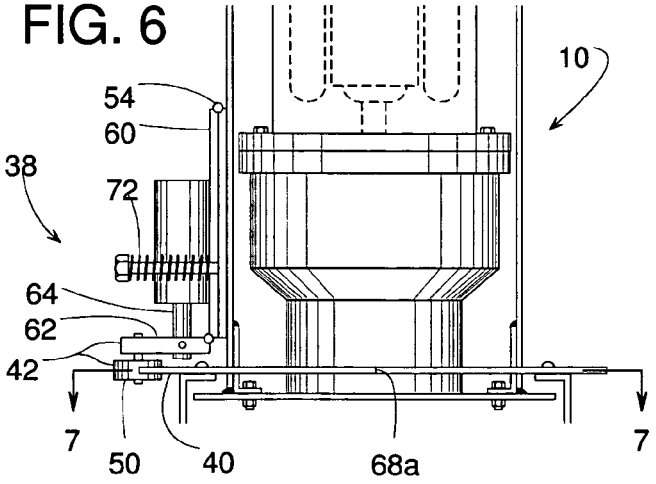
FIG. 6 is a side view similar to FIG. 4 with the roller engaging a valley of the fan's lobed member.
Figure 7:
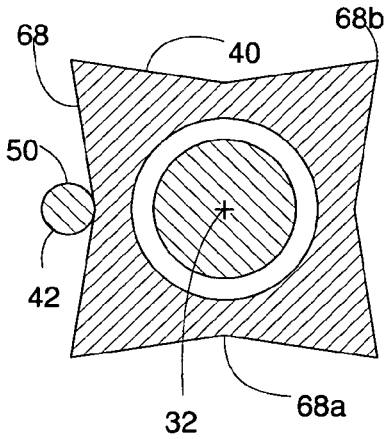
FIG. 7 is a cross-sectional view taken along line 7-7 of FIG. 6.
Figure 8:
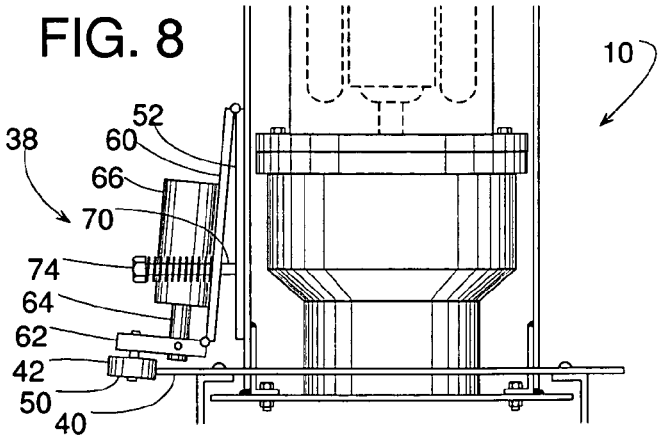
FIG. 8 is a side view similar to FIG. 6 but showing the roller at a peak of the fan's lobed member.

Referring to FIGS. 4-8, fan 10, for instance, includes a stop mechanism 38 comprising a lobed member 40, a catch mechanism 42, and an actuator such as a solenoid 44 for selectively engaging and disengaging catch mechanism 42 from lobed member 40. When fan 10 is turned on (FIGS. 1, 2 and 5), catch mechanism 42 disengages lobed member 40 to enable fan blades 14 to spin freely. When fan 10 turns off (FIGS. 3, 4, 6, 7 and 8), catch mechanism 42 engages lobed member 40 to urge fan 10 to stop at a predetermined desired location. FIGS. 4, 6, 7 and 8 show catch mechanism 42 engaged with lobed member 40, and FIGS. 1 and 5 show catch mechanism 42 disengaged from lobed member 40. Depending on the design, either lobed member 40 or catch mechanism 42 rotates with fan blades 14, while the other one is anchored at a substantially stationary point (e.g., point 36). For the illustrated example, a bracket 48 affixes lobed member 40 to fan blades 14, so lobed member 40 and fan blades 14 rotate together as a unit.

In this example, catch mechanism 42 includes a roller 50; however, other catch mechanisms (e.g., a pawl) are also well within the scope of this disclosure. To mount catch mechanism 42, a stationary leaf 52 of a hinge 54 is anchored at a fixed point on a substantially stationary housing 56 within which fan rotor 26 rotates when fan 10 is on. A hinge pin 58 pivotally couples a pivotal leaf 60 of hinge 54 to stationary leaf 52. An arm 62 supporting roller 50 is pivotally attached to pivotal leaf 60 at a pivot point 63. Electric solenoid 44 or an alternate actuator includes a plunger 64 connected to arm 62 and a cylinder 66 attached to pivotal leaf 60. Solenoid 44 retracting plunger 64 to the solenoid's 44 run position of FIGS. 1 and 5 lifts arm 62 to disengage roller 50 from lobed member 40, thereby enabling fan blades 14 to spin when fan 10 is turned on. When fan 10 turns off, solenoid 44 extends plunger 64 to the solenoid's 44 stop position of FIGS. 4, 6 and 8, which lowers arm 62 to move roller 50 into engagement with lobed member 40 (see also FIG. 7). To ensure proper blade-stopping operation during a power failure, plunger 64 preferably is extended by spring force when solenoid 44 is de-energized.

To urge fan rotor 26 to the likely stop position of FIGS. 3, 4, 6 and 7, fan 10 is de-energized and roller 50 is forced radially toward lobed member 40 such that roller 50 follows an outer peripheral contour 68 of lobed member 40. The radial pressure that roller 50 exerts against lobed member 40 urges roller 50 to settle into one of the valleys 68a of peripheral contour 68 (FIG. 7), thus urging fan blades 14 to coast to stop at those likely positions.

To force roller 50 against lobed member 40, a stud 70 extends from stationary leaf 52 and slidingly protrudes through a hole in pivotal leaf 60. A spring 72 having a larger outer diameter greater than that of the hole through which stud 70 extends in pivotal leaf 60 is compressed between a head 74 of stud 70 and the outer face of pivotal leaf 60. Spring 72 urges the leaves 52 and 60 of hinge 54 toward each other, thereby urging roller 50 radially against lobed member 40. The flexibility of spring 72 allows hinge 54 to pivot open (compare FIGS. 6 and 8), which enables roller 50 to roll over peaks 68b (FIG. 7) of lobed member 40.

To adjust the position at which fan rotor 26 tends to stop in relation to sprinkler head 12, hinge 54 can be relocated and mounted at some other location around housing 56. Alternatively, lobed member 40 can be disconnected from bracket 48, shifted rotationally about axis 32 relative to housing 56, and reattached to bracket 48.

Although roller 50 rolls along the outer peripheral contour 68 of lobed member 40, wherein the lobes protrude radially outward from lobed member 40, it is also well within the scope of this disclosure to have the lobed member 40 be wavy vertically, rather than radially, wherein the lobes protrude axially upward and roller 50 is oriented to roll along the axial wavy face of the lobed member 40.

In addition, to minimize the forces on the catch mechanism 42 and fan rotor 26 from rapid deceleration, a timer (not shown) may be employed to prevent the catch mechanism 42 from engaging the fan rotor 26 for some period of time after the fan 10 is de-energized to enable the fan 10 to spin down to a slower rotational speed. A rotational sensor (not shown) could be used for some purpose.

Figure 9:
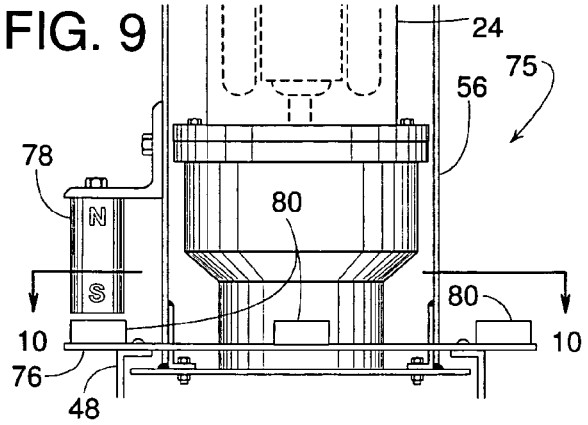
FIG. 9 is a side view similar to FIGS. 5, 6 and 8 but showing another example of a ceiling fan.
Figure 10:
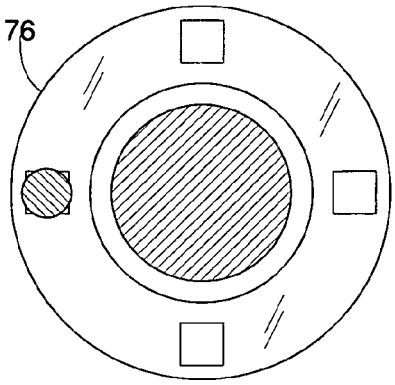
FIG. 10 is a cross-sectional view taken along line 10-10 of FIG. 9.

As an alternative to using lobed member 40 and stop mechanism 38 to bias the fan rotor 26 to likely stop positions, another example ceiling fan 75 includes a disk 76 connected to rotate with fan blades 14, as shown in FIGS. 9 and 10. To bias fan blades 14 to stop at one or more likely stop positions, a generally stationary magnet 78 (permanent or electromagnetic) attracts one or more iron pads 80 that are attached to disk 76. When fan 75 turns off (or at a later time when fan 75 has slowed), and fan blades 14 begin coasting to a stop, iron pads 80 pass sequentially underneath magnet 78. Eventually the rotation of fan blades 14 becomes sufficiently slow that the magnetic force from magnet 78 is sufficient to slow and stop pad 80 underneath magnet 78, as shown in FIGS. 9 and 10. In this example, there are four pads 80 distributed 90 degrees apart so that fan blades 14 tend to stop in the position shown in FIG. 3. However, in other examples, any other number of pads 80 (e.g., 1, 2, 3, etc.) may be used instead.

To adjust the position at which fan blades 14 tend to stop in relation to sprinkler head 12, magnet 78 can be relocated and mounted at some other location around housing 56. Alternatively, pads 80 can be attached to other locations around disk 76.

Figure 11:
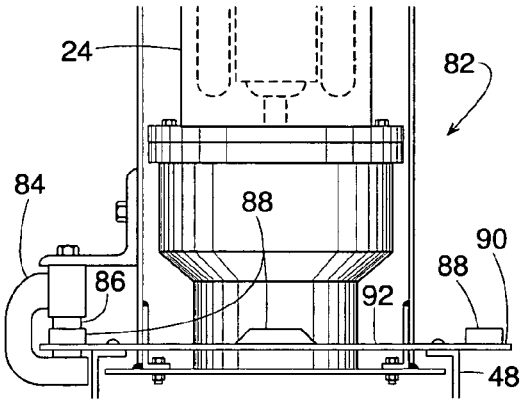
FIG. 11 is a side view showing an example of a ceiling fan being stopped by a brake.
Figure 12:
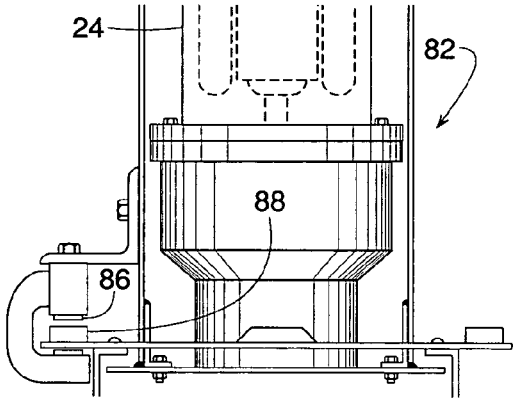
FIG. 12 is a side view similar to FIG. 11 but showing the brake released and the fan blades rotating freely.

FIGS. 11 and 12 show an example ceiling fan 82, wherein an electrically actuated caliper brake 84 with a brake pad 86 replaces magnet 78 of fan 75 to bias the fan rotor 26 to likely stop positions. Brake 84 is mounted at a generally stationary point on fan 82. Brake pad 86, which is movable between a run position (FIG. 12) and a stop position (FIG. 11), is adapted to frictionally engage any number of raised areas 88 on a brake rotor 90 that is mounted to rotate with fan blades 14. Raised areas 88 are of vertical thickness that is greater than the minimum vertical caliper opening of brake 84 so that brake 84 can effectively clamp onto any of those raised areas 88. To prevent brake 84 from clamping onto a thinner area 92 of rotor 90, between two raised areas 88, the vertical thickness of thinner areas 92 should be less than the minimum caliper opening of brake 84.

When fan 82 turns off (or a later time when the fan 75 has slowed), brake 84 closes to the minimum caliper opening (stop position of FIG. 11), and fan blades 14 and fan rotor 26 coast until a raised area 88 becomes clamped within brake 84, thereby stopping fan 82 at a predetermined likely stop position. When fan 82 is turned on, brake 84 opens to the run position of FIG. 12, wherein brake pad 86 disengages raised area 88 to enable fan blades 14 to spin freely.

Figure 13:
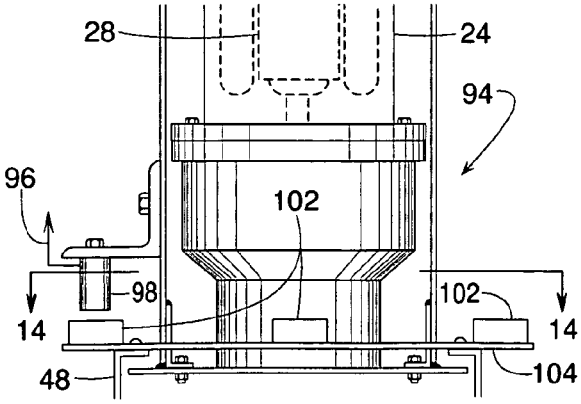
FIG. 13 is a side view similar to FIG. 9 but showing yet another example of a ceiling fan.
Figure 14:
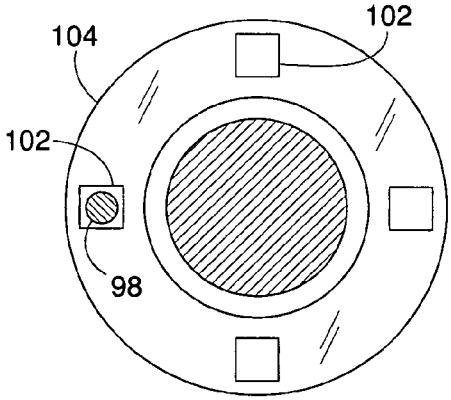
FIG. 14 is a cross-sectional view taken along line 14-14 of FIG. 13.

FIGS. 13 and 14 show an example of a ceiling fan 94 that is biased to a predetermined likely stop position by use of the controller 22 with a feedback system. Controller 22 (FIG. 1) selectively (i.e., on/off—pulsed or single shot) and/or controllably (i.e., variable speed) energizes motor 24 in response to a feedback signal 96 from a rotational position sensor 98. Sensor 98 is schematically illustrated to represent any transducer capable of sensing the position of one or more rotating elements of fan 94, wherein examples of rotating elements include, but are not limited to, motor 24, rotor 28; rotating field, voltage or current; a fan hub 100 (FIG. 4); and the plurality of fan blades 14. Examples of sensor 98 include, but are not limited to, a photoelectric eye, Hall effect proximity sensor, electromechanical limit switch, etc.

In some examples, fan 82 would be sensor 98 being a Hall effect sensor that detects the presence of one or more iron pads 102 on a disc 104 that rotates with fan blades 14. Pads 102 can be positioned such that fan blades 14 are at a predetermined likely stop position when one of pads 102 is aligned with sensor 98. Alternatively, pads 102 can be positioned such that the likely stop position is where sensor 98 is situated midway between two pads 102. Either way, controller 22 (FIG. 1) enables fan 94 to coast to a stop. If fan 94 stops at a desired likely stop position, controller 22 leaves fan 94 de-energized. If, however, fan 94 fails to stop at a predetermined likely stop position, then controller 22 feeds motor 24 with a brief pulse of current to "bump" fan 94 away from its undesirable stop position. If fan 94 subsequently stops at a desired likely stop position, controller 22 leaves fan 94 de-energized; otherwise, controller 22 gives motor 24 another brief pulse of current. Such a bump-and-coast method continues until fan 94 stops at a desired likely stop position.

Figure 15:
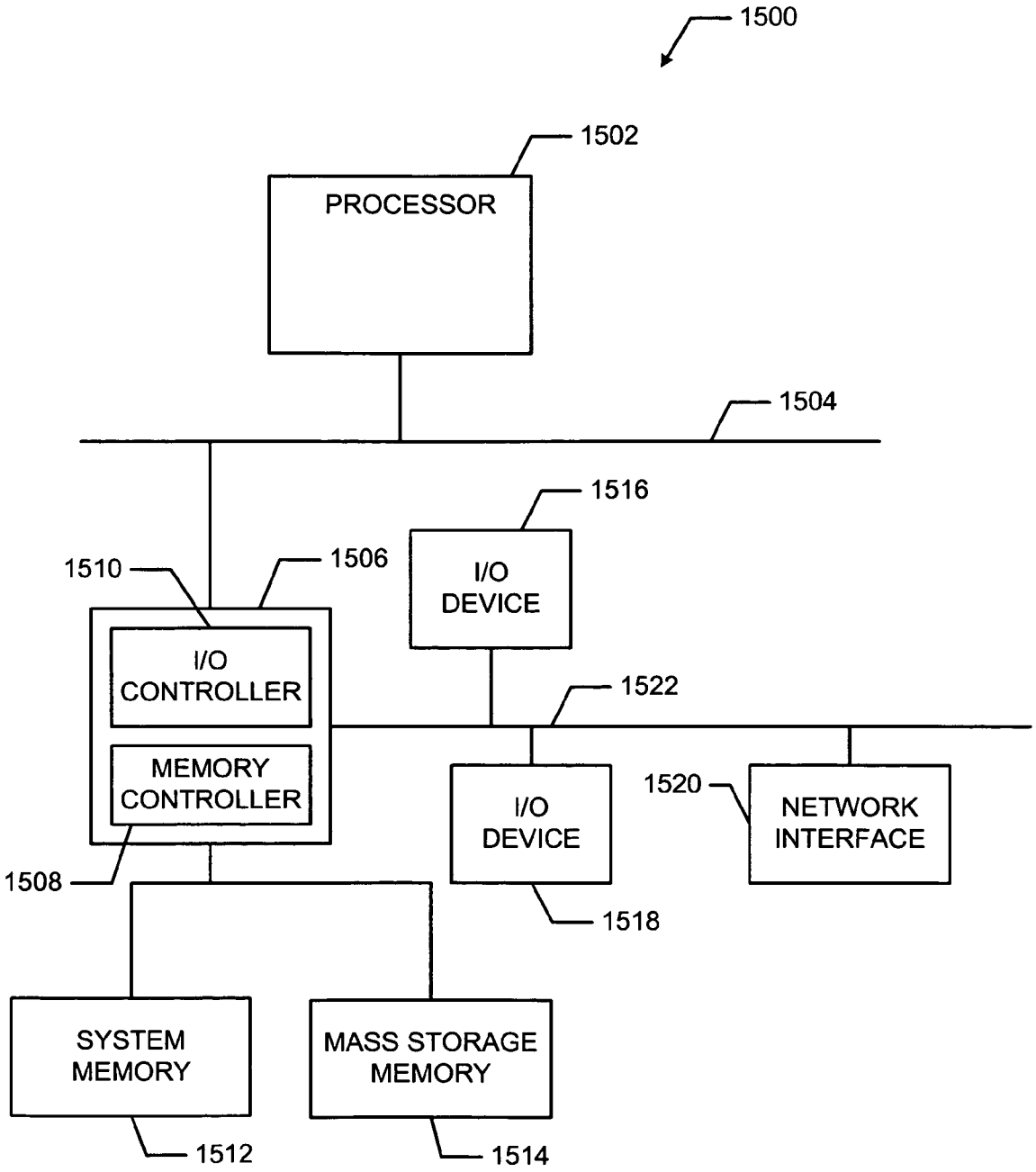
FIG. 15 illustrates an example manner of implementing the controller of FIG. 1.

FIG. 15 is a block diagram of an example processor system 1500 that may be used to implement the example controller 22 and feedback system of FIG. 1. As shown in FIG. 15, the processor system 1500 includes a processor 1502 that is coupled to an interconnection bus 1504. The processor 1502 may be any suitable processor, processing unit or microprocessor. Although not shown in FIG. 15, the processor system 1500 may be a multi-processor system and, thus, may include one or more additional processors that are identical or similar to the processor 1502 and that are communicatively coupled to the interconnection bus 1504.

The processor 1502 of FIG. 15 is coupled to a chipset 1506, which includes a memory controller 1508 and an input/output (I/O) controller 1510. The chipset provides I/O and memory management functions as well as a plurality of general purpose and/or special purpose registers, timers, etc. that are accessible or used by one or more processors 1502 coupled to the chipset 1506. The memory controller 1508 performs functions that enable the processor 1502 (or processors if there are multiple processors) to access a system memory 1512 and a mass storage memory 1514, if present.

The system memory 1512 may include any desired type of volatile and/or non-volatile memory such as, for example, static random access memory (SRAM), dynamic random access memory (DRAM), flash memory, read-only memory (ROM), etc. The mass storage memory 1514 may include any desired type of mass storage device including hard disk drives, optical drives, tape storage devices, etc.

The I/O controller 1510 performs functions that enable the processor 1502 to communicate with peripheral input/output (I/O) devices 1516 and 1518 and a network interface 1520 via an I/O bus 1522. The I/O devices 1516 and 1518 may be any desired type of I/O device such as, for example, a keyboard, a video display or monitor, a mouse, etc. The network interface 1520 may be, for example, an Ethernet device, an asynchronous transfer mode (ATM) device, an 802.11 device, a DSL modem, a cable modem, a cellular modem, etc. that enables the processor system 1500 to communicate with another processor system.

While the memory controller 1508 and the I/O controller 1510 are depicted in FIG. 15 as separate functional blocks within the chipset 1506, the functions performed by these blocks may be integrated within a single semiconductor circuit or may be implemented using two or more separate integrated circuits.

At least some of the aforementioned examples include one or more features and/or benefits including, but not limited to, the following: In some examples, a ceiling fan stops at a predetermined likely stop position to purposely avoid obstructing an overhead sprinkler head.

In some examples, the location of the predetermined likely stop position can be adjusted relative to the fan's motor housing.

In some examples, the location of the predetermined likely stop position can be adjusted after the fan has already been installed near the ceiling.

In some examples, the fan automatically turns off in the event of a fire. In some examples, the fan stops at a desired likely stop position without having to rely on electrical power to do so.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A ceiling fan that can be selectively turned on and off, the ceiling fan comprising:

a fan rotor to be urged to at least one likely stop position when the ceiling fan is turned off; and a plurality of fan blades to rotate with the fan rotor and to extend radially outward from an axis about which the plurality of fan blades rotate, the plurality of fan blades to sweep along a generally circular path when the ceiling fan is on, each fan blade of the plurality of fan blades to be stopped purposely to avoid at least one predetermined point, associated with the at least one likely stop position, on the generally circular path when the ceiling fan is turned off and the fan rotor is stopped at the at least one likely stop position, wherein the ceiling fan is to be mounted in proximity with a sprinkler head such that the fan blades are to pass directly under the sprinkler head when the ceiling fan is on, and wherein the at least one predetermined point is based on a location of the sprinkler head.

2. The ceiling fan of claim 1, further comprising a fire-related sensor, the ceiling fan to automatically turn off in response to the fire-related sensor responding to the fire.

3. The ceiling fan of claim 1, wherein the at least one likely stop position is one of a plurality of likely stop positions, and each fan blade of the plurality of fan blades is to purposely avoid the at least one predetermined point when the ceiling fan is off and the fan rotor is at any of the plurality of likely stop positions.

4. The ceiling fan of claim 1, further comprising a substantially stationary housing within which the fan rotor is to rotate when the ceiling fan is on, wherein a location of the at least one likely stop position is to be adjustable relative to the substantially stationary housing.

5. The ceiling fan of claim 1, further comprising a magnet to urge the fan rotor to the at least one likely stop position when the ceiling fan is off

6. The ceiling fan of claim 1, further comprising an actuator to be movable between a run position and a stop position relative to the fan rotor such that when the actuator is in the stop position the fan rotor is urged to the at least one likely stop position.

7. The ceiling fan of claim 6, wherein the actuator is to move to the stop position when the actuator is de-energized.

8. The ceiling fan of claim 1, further comprising a brake pad and a brake rotor, at least one of the brake pad or the brake rotor is to be mounted at a rotating point that rotates with the fan rotor, at least an opposite one of the brake pad or the brake rotor is to be anchored at a substantially stationary point, the brake pad is to be adjacent the brake rotor and is to be selectively movable to a run position and a stop position such that in the stop position the brake pad is to grip the brake rotor to stop the fan rotor at the at least one likely stop position, and in the run position the brake pad is to release the brake rotor to enable the fan rotor to rotate freely.

9. The ceiling fan of claim 1, further comprising a lobed member and a catch mechanism, at least one of the lobed member or the catch mechanism is to be mounted at a rotating point that is to rotate with the fan rotor, at least an opposite one of the lobed member and the catch mechanism is to be anchored at a substantially stationary point, the catch mechanism is to be adjacent the lobed member and is movable between a run position and a stop position such that in the stop position the catch mechanism is to engage the lobed member to stop the fan rotor at the at least one likely stop position, and in the run position the catch mechanism is to release the lobed member to enable the fan rotor to rotate freely.

10. The ceiling fan of claim 9, wherein the catch mechanism includes a roller that is to engage the lobed member when the catch mechanism is in the stop position and the roller is to disengage the lobed member when the catch mechanism is in the run position.

11. The ceiling fan of claim 1, further comprising:

a plurality of rotating elements that include the fan rotor with the plurality of fan blades; and a rotational position sensor to be mounted at a substantially fixed location in sufficient proximity with the plurality of rotating elements to provide a signal that varies as a function of a rotational position of the plurality of fan blades.

12. The ceiling fan of claim 11, further comprising a controller to electrically drive a motor that is to be connected to the fan rotor to rotate the plurality of fan blades, the controller is to sometimes drive the motor in response to the rotational position sensor so as to urge the fan rotor to the at least one likely stop position.

13. A ceiling fan that can be selectively turned on and off, the ceiling fan is mountable in proximity with a sprinkler head, the ceiling fan comprising:

a fan rotor to be urged to at least one likely stop position when the ceiling fan is off;

a plurality of fan blades to rotate with the fan rotor and to extend radially outward from an axis about which the plurality of fan blades rotate, the plurality of fan blades to sweep along a generally circular path when the ceiling fan is on; and at least one predetermined point on the generally circular path wherein one of the plurality of fan blades would interfere with a spray pattern of a sprinkler head if the one fan blade were not to avoid the sprinkler head when the ceiling fan is off, each fan blade of the plurality of fan blades to be stopped purposely to avoid the at least one predetermined point when the ceiling fan is off and the fan rotor is stopped at the at least one likely stop position.

14. The ceiling fan of claim 13, further comprising a magnet to urge the fan rotor to the at least one likely stop position when the ceiling fan is off.

15. The ceiling fan of claim 13, further comprising a solenoid to be movable between a run position and a stop position relative to the fan rotor such that when the solenoid is in the stop position the fan rotor is urged to the at least one likely stop position.

16. The ceiling fan of claim 13, further comprising a brake pad and a brake rotor, at least one of the brake bad or the brake rotor is to be mounted at a rotating point that rotates with the fan rotor, at least an opposite one of the brake pad or the brake rotor is to be anchored at a substantially stationary point, the brake pad is to be adjacent the brake rotor and is to be selectively movable to a run position and a stop position such that in the stop position the brake pad is to grip the brake rotor to stop the fan rotor at the at least one likely stop position, and in the run position the brake pad is to release the brake rotor to enable the fan rotor to rotate freely.

17. The ceiling fan of claim 13, further comprising a lobed member and a catch mechanism, at least one of the lobed member or the catch mechanism is to be mounted at a rotating point that rotates with the fan rotor, at least an opposite one of the lobed member or the catch mechanism is to be anchored at a substantially stationary point, the catch mechanism is to be adjacent the lobed member and is to be movable between a run position and a stop position such that in the stop position the catch mechanism is to engage the lobed member to stop the fan rotor at the at least one likely stop position, and in the run position the catch mechanism is to release the lobed member to enable the fan rotor to rotate freely.

18. A method of operating a ceiling fan in proximity with a sprinkler head, the method comprising:

rotating a plurality of fan blades in proximity with the sprinkler head such that at least one fan blade of the plurality of fan blades defines a generally circular path;

establishing at least one predetermined point on the generally circular path based on a location of the sprinkler head, the location of the sprinkler head being directly above the generally circular path of the at least one fan blade, the predetermined point associated with at least one likely stop position of the fan; and stopping the rotation of the plurality of fan blades by urging the fan to the at least one likely stop position such that each fan blade of the plurality of fan blades stops to avoid the at least one predetermined point when the plurality of fan blades stop rotating.

19. The method of claim 18, further comprising:

triggering a fire-related sensor;

upon triggering a fire-related sensor, stopping the rotation of the plurality of fan blades such that each fan blade of the plurality of fan blades avoids the at least one predetermined point when the plurality of fan blades stop rotating.

20. The method of claim 18, further comprising rotating the plurality of fan blades underneath the sprinkler head to define the circular path which is underneath a spray pattern of the sprinkler head.

21. The ceiling fan of claim 1, wherein the one predetermined point is the location of the sprinkler head.

* * * * *

UNITED STATES PATENT AND TRADEMARK OFFICE

CERTIFICATE OF CORRECTION

PATENT NO. : 8,622,712 B2
APPLICATION NO. : 12/228170
DATED : January 7, 2014
INVENTOR(S) : Wiegel et al.

It is certified that error appears in the above-identified patent and that said Letters Patent is hereby corrected as shown below:

In the Claims:

In claim 9 at column 7, line 44, the phrase "the lobed member and the catch mechanism" should read -- the lobed member or the catch mechanism --.

Signed and Sealed this
Twenty-ninth Day of April, 2014

Michelle K. Lee

Michelle K. Lee
*Deputy Director of the United States Patent and Trademark Office*